US005988056A

United States Patent [19]

Bolch

[11] Patent Number: 5,988,056

[45] Date of Patent: Nov. 23, 1999

[54] PRINTING APPARATUS AND METHOD

[75] Inventor: Michael W. Bolch, Raleigh, N.C.

[73] Assignee: Acroprint Time Recorder Company, Raleigh, N.C.

[21] Appl. No.: 09/094,097

[22] Filed: Jun. 9, 1998

[51] Int. Cl.[6] ..... B41J 21/00

[52] U.S. Cl. ..... 101/72; 101/287; 101/93; 400/120.01; 346/82; 346/87

[58] Field of Search ..... 101/55, 56, 57, 101/68, 69, 70, 72, 93, 287, 93.05; 400/124.01, 316; 346/78, 80, 82, 84, 87, 89

[56] References Cited

U.S. PATENT DOCUMENTS

| | | | |
|---|---|---|---|
| 602,026 | 4/1898 | Blessing | 346/82 |
| 3,101,046 | 8/1963 | Spiazzi | 101/57 |
| 4,420,759 | 12/1983 | Maejima | 346/89 |
| 4,949,098 | 8/1990 | Gluck et al. | 400/56 |
| 5,136,937 | 8/1992 | Nogawa | 101/72 |
| 5,325,773 | 7/1994 | Manduley | 101/287 |
| 5,761,996 | 6/1998 | Gauthier et al. | 101/93 |

*Primary Examiner*—Christopher A. Bennett
*Attorney, Agent, or Firm*—William A. Barrett; Steven J. Hultquist

[57] ABSTRACT

A printing device wherein top frontal positioning of motor and drive train is avoided so that the size of the top portion can be reduced thereby improving the ability of the operator to view the alignment of a printable article in relation to the printer. The device includes a printer rack having a vertical support member and a base; a moving clamping piece movably mounted on the printer rack permitting the clamping piece to move towards and away from the base; a printer movably mounted on the clamping piece; a cam shaft rotatably mounted on the printer rack and provided thereon with a cylindrical cam for moving the printer towards and away from the vertical support member and further provided thereon with means for raising and lowering the clamping piece so that the clamping piece clamps the article during printing and releases the article upon completion of printing; and a motor mounted on the printer rack for turning the cam shaft.

19 Claims, 6 Drawing Sheets

PRINTING APPARATUS AND METHOD

FIELD OF THE INVENTION

The present invention relates generally to a printing device. The printing device is usefully employed as a time recorder, printing the time, date, location and other information onto a time card or other printable article. In one embodiment, this printing device operates as a "side printer" which generally prints text or symbols perpendicular to the side of the media. In another embodiment the printer can operate as a "time stamp" which generally prints parallel to the side of the media.

BRIEF DESCRIPTION OF THE PRIOR ART

Side printers and timestamps are commonly used for printing time, date and other information on a time card or other media.

However, as can be seen in FIGS. 1A and 1B (PRIOR ART), traditional time clocks employing dot matrix printers have many bulky components, such as the cam, motor, drive train, printer and printer ribbon, which can obscure the view of the operator, making it difficult to line up the time card at the appropriate position. Typically, these devices employ only a small window through which the operator must view the time card from an obscure angle.

It is therefore desirable to provide a printing device in which some of the bulky components, e.g., the motor and drive train are removed from the front of the top portion of the device so that the size of the top portion can be reduced thereby improving the ability of the operator to view the alignment of the time card or other media in relation to the printer. It is also desirable to reposition other elements, e.g., the cam shaft, to allow for improved viewing of the time card alignment.

It is therefore an object of the present invention to provide a printing device in which some of the bulky components have been repositioned to allow easier viewing of the alignment of the time card.

Other objects and advantages of the invention will be more fully apparent from the ensuing disclosure and appended claims.

SUMMARY OF THE INVENTION

The present invention in one aspect relates to a printing device comprising:

(1) a printer rack comprising a base having a front portion and a rear portion, a vertical support member having a top portion and a bottom portion, the bottom portion of the vertical support member is attached to the rear portion of the base, and the vertical support member is erected from the base in a generally vertical direction, a horizontal support member having a front portion and a rear portion, the rear portion is attached to the top portion of the vertical support member and extends from the vertical support member in a generally horizontal direction, and a front support member having an upper portion and a lower portion, the upper portion is attached to the front portion of the horizontal support member and extends generally vertically downward towards the base but without contacting the base so as to leave a space between the lower portion of the front support member and the base for the insertion of an article for printing;

(2) a clamping piece having a front edge and a rear edge, said clamping piece is movably mounted between the front support member of the printer rack and the vertical support member of the printer rack such that the clamping piece can move towards and away from the base;

(3) a printer movably mounted on the clamping piece;

(4) a cam shaft rotatably mounted on the printer rack and provided thereon with a cylindrical cam in moving connection to the printer for moving the printer towards and away from the vertical support member; and one or more means for raising and lowering the clamping piece so that the clamping piece clamps the article during printing; and (5) a motor mounted on the printer rack for turning the cam shaft.

In one method aspect, the present invention relates to a method of printing information on a printable article, comprising:

(A) providing a printing device comprising:

(1) a printer rack including:

(a) a base having a front portion and a rear portion;

(b) a vertical support member having a top portion and a bottom portion, the bottom portion of the vertical support member is attached to the rear portion of the base, and the vertical support member is erected from the base in a generally vertical direction;

(c) a horizontal support member having a front portion and a rear portion, the rear portion is attached to the top portion of the vertical support member and extends from the vertical support member in a generally horizontal direction;

(d) a front support member having an upper portion and a lower portion, the upper portion is attached to the front portion of the horizontal support member and extends generally vertically downward towards the base but without contacting the base so as to leave a space between the lower portion of the front support member and the base for the insertion of an article for printing;

(2) a clamping piece having a front edge and a rear edge, said clamping piece is movably mounted between the front support member of the printer rack and the vertical support member of the printer rack such that the clamping piece can move towards and away from the base;

(3) a printer movably mounted on the clamping piece;

(4) a cam shaft rotatably mounted on the printer rack and provided thereon with:

(a) a cylindrical cam in moving connection to the printer for moving the printer towards and away from the vertical support member; and (b) one or more means for raising and lowering the clamping piece so that the clamping piece clamps the article during printing;

(5) a motor mounted on the printer rack for turning the cam shaft;

(B) inserting the printable article into the printing device; and (C) actuating the printer motor to rotate the cam thereby simultaneously lowering the clamping piece to secure the printable article and moving the printer across the printable article while the printer prints the information on the printable article.

Other features, aspects and embodiments of the present invention will be more fully apparent from the ensuing description and appended claims.

DETAILED DESCRIPTION OF THE INVENTION, AND PREFERRED EMBODIMENTS THEREOF

Figure 1A:
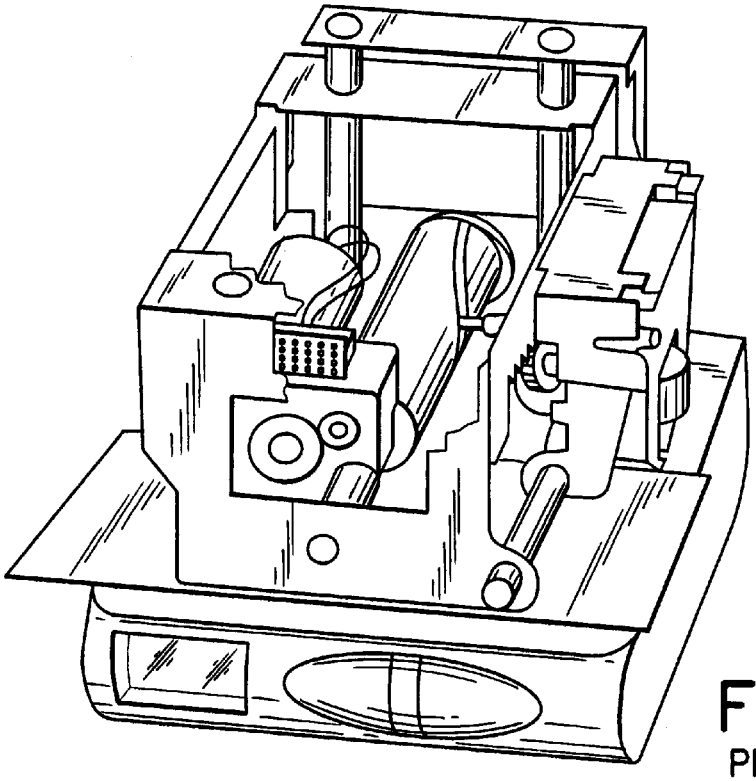
FIG. 1A PRIOR ART
FIGS. 1A and 1B (PRIOR ART) are front views of a printer of the prior art with and without the cover showing the bulky top portion thereof and the small viewing window.
Figure 1B:
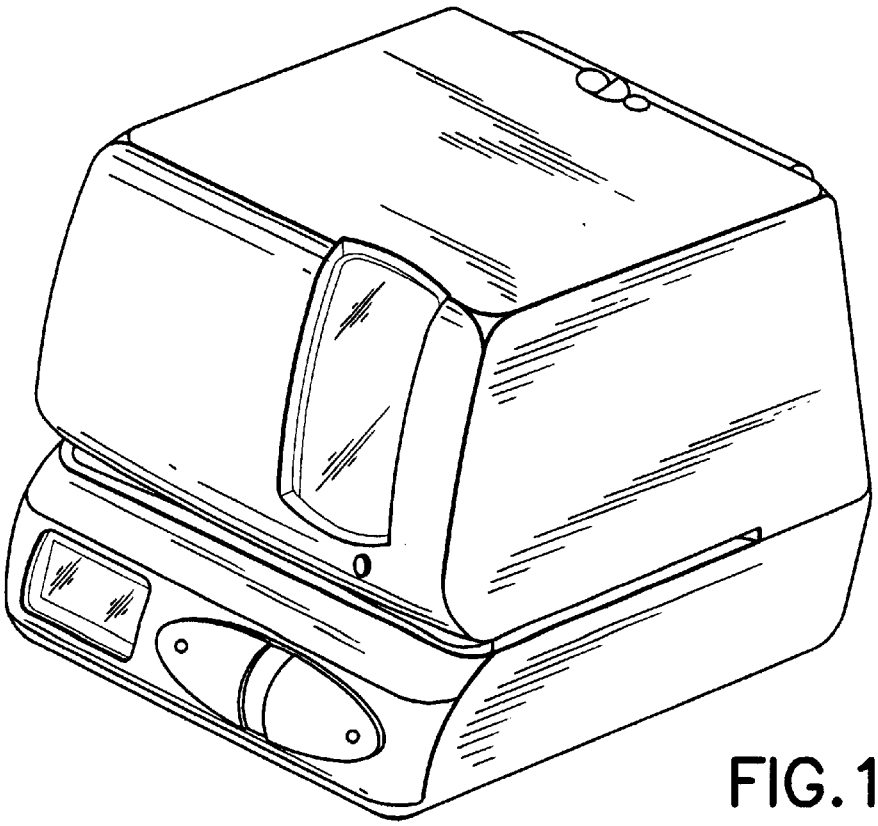
FIG. 1B PRIOR ART
Figure 2A:
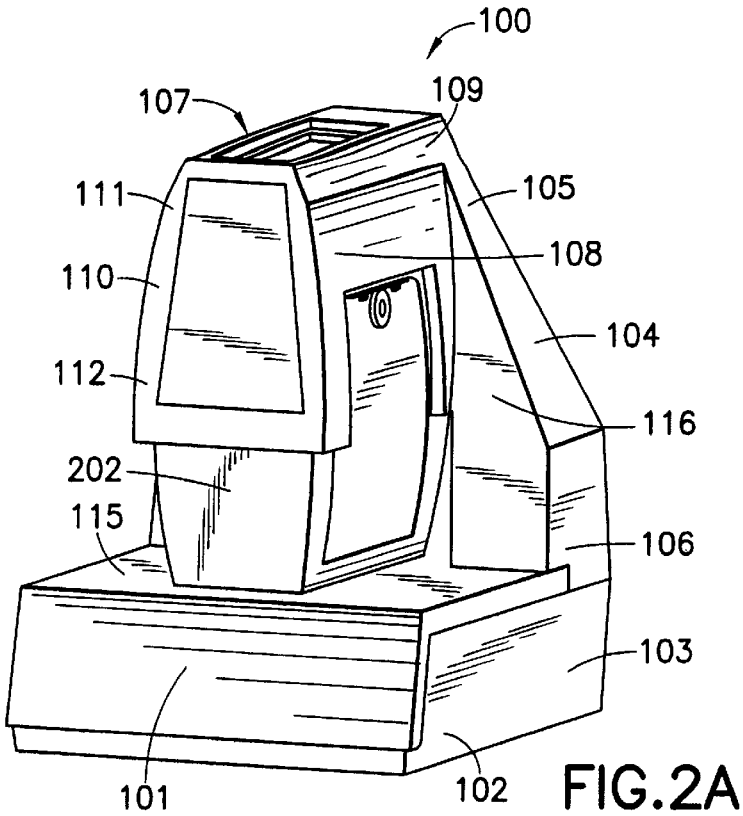
FIGS. 2A and 2B are front and side views of a printer according to one embodiment of the present invention showing the reduced size of the top portion thereof.
Figure 2B:
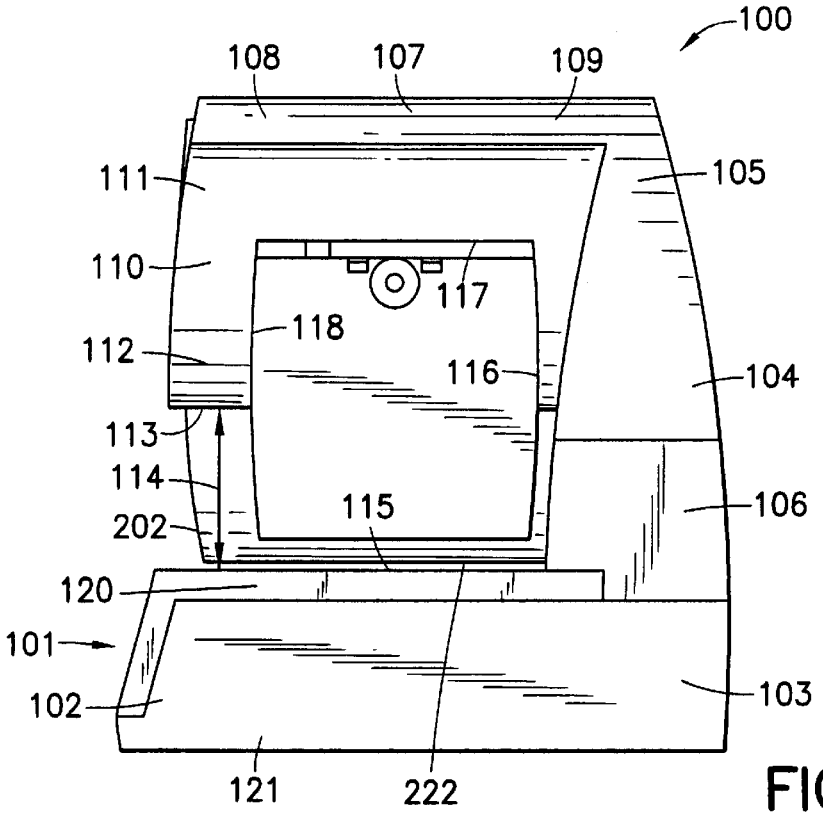

FIGS. 2A and 2B show a side view of the printing device according to one embodiment of the present invention. The printing device has a printer rack 100 which serves as frame and a case for supporting and/or housing the various components of the printer device in a working relationship to one another.

The printer rack 100 includes a base 101, a vertical support member 104, a horizontal support member 107, and a front support member 110.

The base 101 comprises a front portion 102, a rear portion 103, and a top portion 115. The base 100 is preferably a component of an independently moveable printer device. Alternatively, the base 101 may be any sufficiently large and stable object to which the remaining components of the printer rack may be attached, e.g., a desk, wall, counter top or table.

The vertical support member 104 has a top portion 105, a bottom portion 106, and an inside portion 116. The bottom portion 106 of the vertical support member 104 is attached to the rear portion 103 of the base 101, and the vertical support member 104 extends from the base 101 in a generally vertical direction.

The horizontal support member 107 includes a front portion 108, a rear portion 109, and a bottom portion . The rear portion 109 is attached to the top portion 105 of the vertical support member 104 and extends from the vertical support member 104 in a generally horizontal direction.

The front support member 110 comprises an upper portion 111, a lower portion 112, a bottom 113 of the lower portion 112, and an inside portion 118. The upper portion 111 is attached to the front portion 108 of the horizontal support member 107 and extends generally vertically downwardly toward the base 101 but without contacting the base 101 so as to leave a space 114 between the bottom portion 113 of the front support member 110 and the top 115 of the base 101, for the insertion of an article for printing.

It will be appreciated that the various support members of the printer rack 100 may be composed of a variety of materials, e.g., plastic, metal, or composite and may be joined together in a variety of ways. For example, the material may be polystyrene, polyurethane, polyvinylchloride (PVC), polysulfone, polycarbonate (PC), polyethylene, acrylonitrile butadiene styrene (ABS), ABS/PVC blend, or ABS/PC blend. In one embodiment, the support members 110, 107 and 104 and the base 101 are formed as a single piece of molded plastic or other material. Alternatively, the support members 110, 107 and 104 may be a single piece which is attached to the base 101 by any means available in the art. For example, the support members 110, 107 and 104 may constitute a single piece with a projecting male component which fits into a matching female component on the base, and the attachment may be further secured by screws, snap fits, glue, welding, or any other suitable means of attachment. Such variety of means can be suitably employed to attach any of the various support members 110, 107 and 104 to each other or to the base.

Another embodiment may include a two-part base with a top portion 120 and a bottom portion 121 to which the upper portion is attached. Any arrangement of pieces which forms a printer rack as shown in FIGS. 2A and 2B is within the scope of the instant invention.

Figure 3:
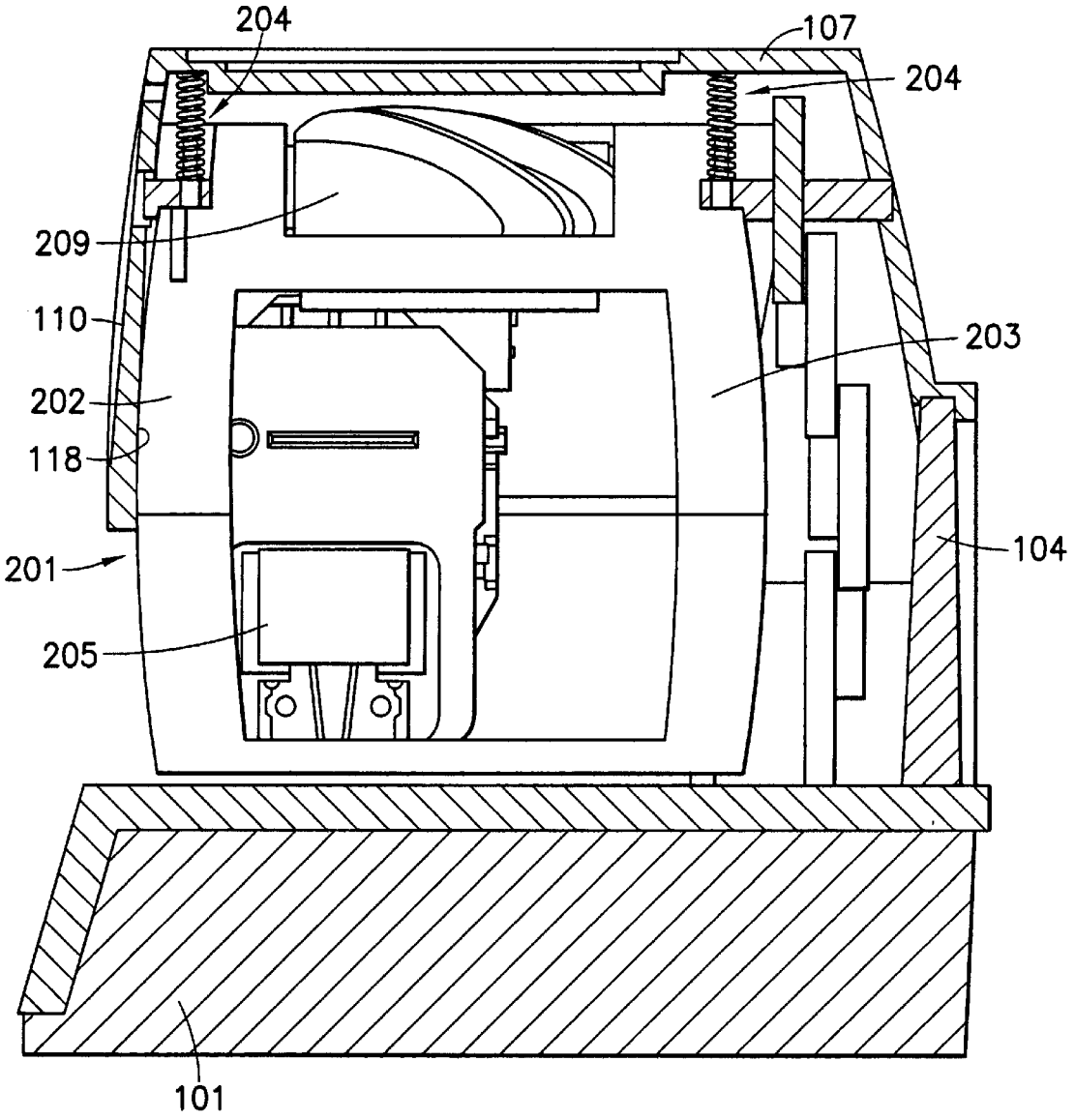
FIGS. 3 is a cross-sectional side view of the printer of FIGS. 2A and 2B.

Referring now to FIG. 3, the printing device preferably has a clamping piece 201 which serves to clamp the printable article in place during printing. The clamping piece 201 has a front support member 202 and a rear support member 203, and is movably mounted between the inside portion 118 of the front support member 110 of the printer rack 100 and the inside portion 116 of the vertical support member 104 of the printer rack 100 such that the clamping piece 201 can move towards and away from the base 101, respectively clamping and unclamping the printable article. Alternatively, the clamping piece 201 can be attached to the printer rack 100 by any means or in any conformation known in the art which permits the clamping piece 201 to move towards and away from the base 101.

Figure 4:
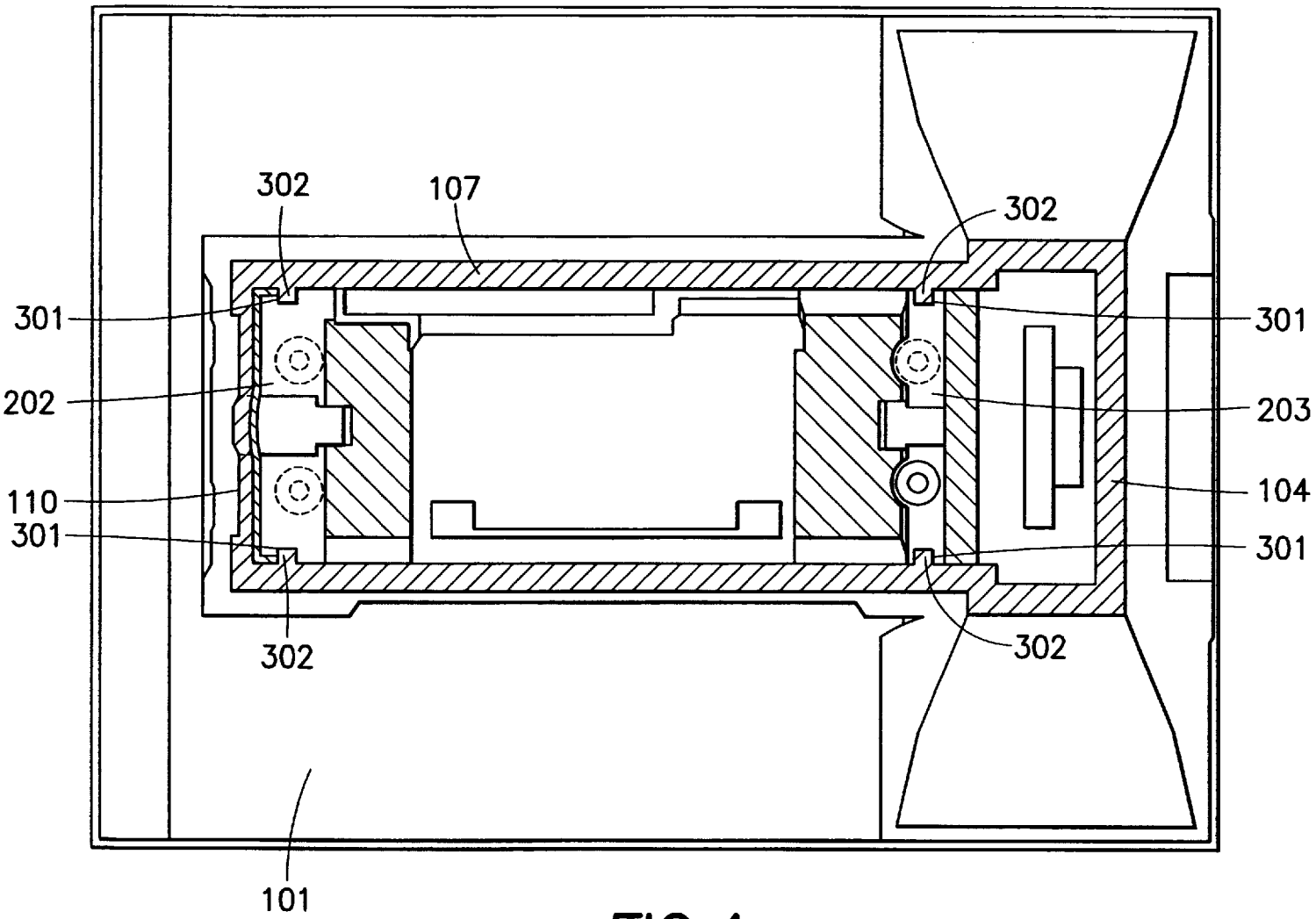
FIG. 4 is a cross-sectional side view from the top of the printer of FIGS. 2A and 2B.

Referring now to FIG. 4, the clamping piece 201 is preferably constrained in this moveable position by the geometry of the clamping piece 201 in relation to the geometry of the inside portions 116 and 118 of the front support member 110 and the vertical support member 104.

For example, in one embodiment, the clamping piece 201 contains grooves 301 in the front support member 110 and the vertical support member 104 so that the clamping piece can slide up and down. Alternatively, the clamping piece 201 may have vertical ridges on the outside portion of its front support member 202 and on the outside portion of its rear support member 203 which are complimentary to vertical grooves 306 on the inside portion 110 of the front support member 110 and on the inside portion 116 of the vertical support member 104 so that the clamping piece 201 fits snugly between the support members and can move towards and away from the base 101.

It will be appreciated by one of skill in the art that the grooves can be rectangular, triangular, semi-circular, or any other shape known in the art by which the external geometry of the clamping piece 201 can be constrained by the internal geometry of the printer rack 100 such that the clamping piece 201 can move up and down within the printer rack 100, i.e., towards and away form the base 101.

It will also be appreciated that the grooves may be on the clamping piece and the corresponding ridges may be on the support members, or that the groove may be on the front portion of the clamping piece and on the rear support member with the ridges on the front support member and the rear portion of the clamping piece.

The ridges and grooves may be in any format in which a groove is matched by a corresponding ridge. Furthermore, the invention may employ a multiplicity of grooves and ridges to movably secure the clamping piece 201 into a position in which it can move towards or away from the base 101.

The clamping piece is 201 preferably made of transparent material so that the operator can visually align the printable article so that the printer prints at the appropriate position. Alternatively, only the portions of the clamping piece 201 through which the operator must view the time card for alignment purposes may be transparent, e.g., the front 202 and bottom 222 portions. (See FIG. 2B)

Referring again to FIGS. 2A and 2B, either the bottom portion 222 of the clamping piece 201 or the top 115 of the base 101 or both may contain friction-enhancing elements. Such friction-enhancing elements may include rubber stoppers or strips, ridges and/or other friction-enhancing elements known in the art. The friction-enhancing elements serve to increase the coefficient of friction between either or both of the base 101 and the bottom portion of the clamping piece 201 and the printable article and thus to reduce the movement of the printable article during printing. In one alternative, the clamping piece 201 itself or the bottom portion 222 of the clamping piece and/or the base 101 may be constructed of a friction-enhancing material.

Referring again to FIG. 3, one or more springs 204 are preferably positioned between the horizontal support member 107 and the clamping piece 201 to introduce a pushing force, normally pushing the clamping piece 201 towards the base 101. Other spring configurations are also possible within the general concept of the present invention. For example, one or more springs exerting a pulling or pushing force may be attached to the clamping piece 201 and to the vertical support member 104 and/or to the front support member 110 and/or to the base 101 in order to normally push or pull the clamping piece in the direction of the base. Other elements exerting pushing and/or pulling forces may be used in place of springs to normally push or pull the clamping piece 201 towards the base, e.g., solenoids, leaf springs, elastomeric compressible resilient elements, etc.

In one aspect of the invention, a printer 205 is movably mounted on the clamping piece 201 so that it can move generally horizontally between the front support member 110 and the vertical support member 104.

The printer is preferably a dot matrix printer, and the printer preferably has a one-way clutch 206 which contacts a horizontal gear element (not shown) i.e., a rack as employed in a rack and pinion system such that as the printer 205 is moved by the helix (described below) across the printable article, either parallel or perpendicular to the top edge of the printable article, the one-way clutch (now shown) is advanced by the horizontal gear element (not shown) to advance the printer ribbon.

Alternatively, the printer may also be a laser printer, an ink-jet printer, band printer, drum printer, daisy wheel, or any other type of printer known in the art.

Figure 5A:
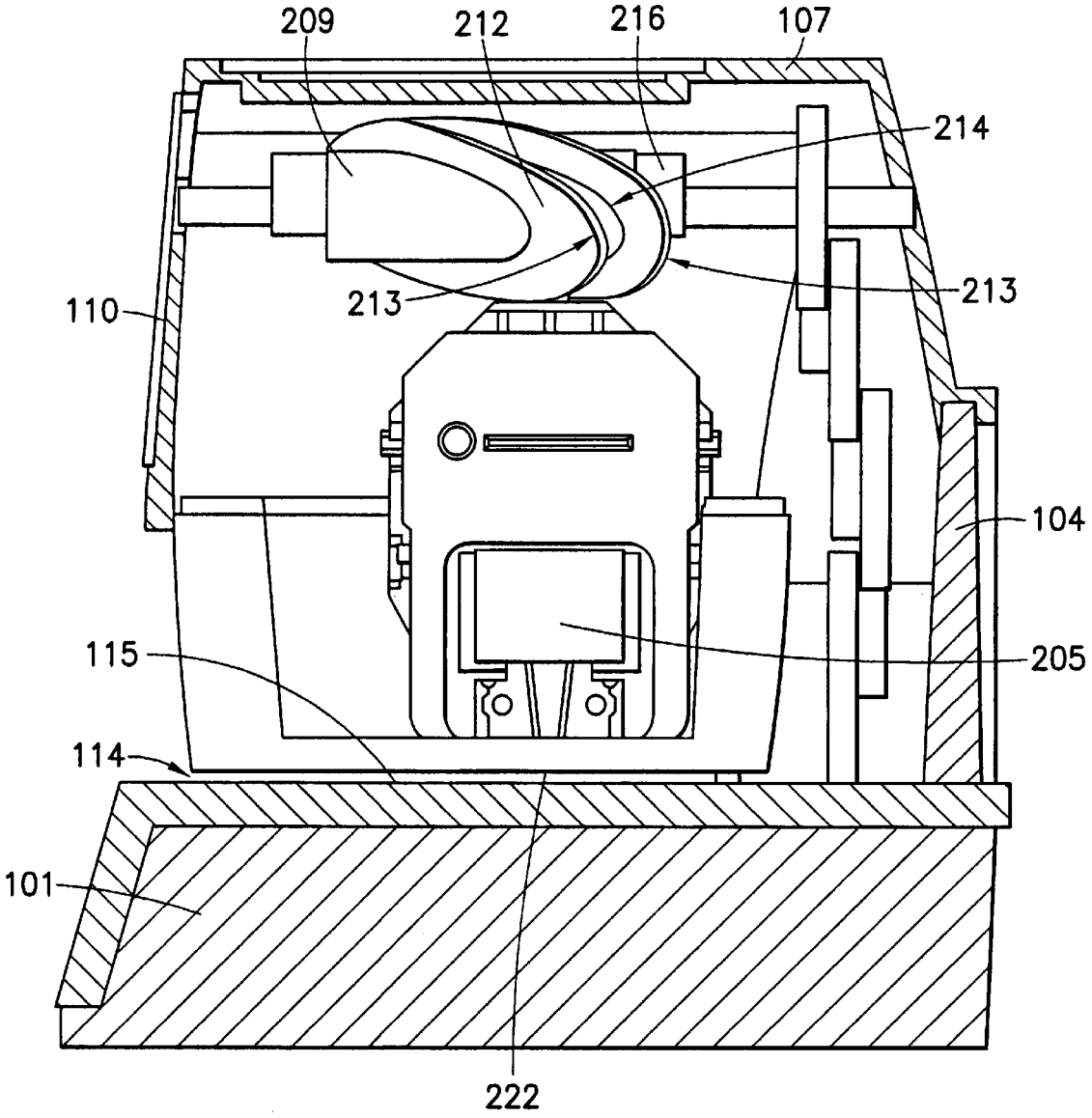
FIGS. 5A and 5B are cross-sectional side views of the printer of FIGS. 2A and 2B showing the details of construction thereof.
Figure 5B:
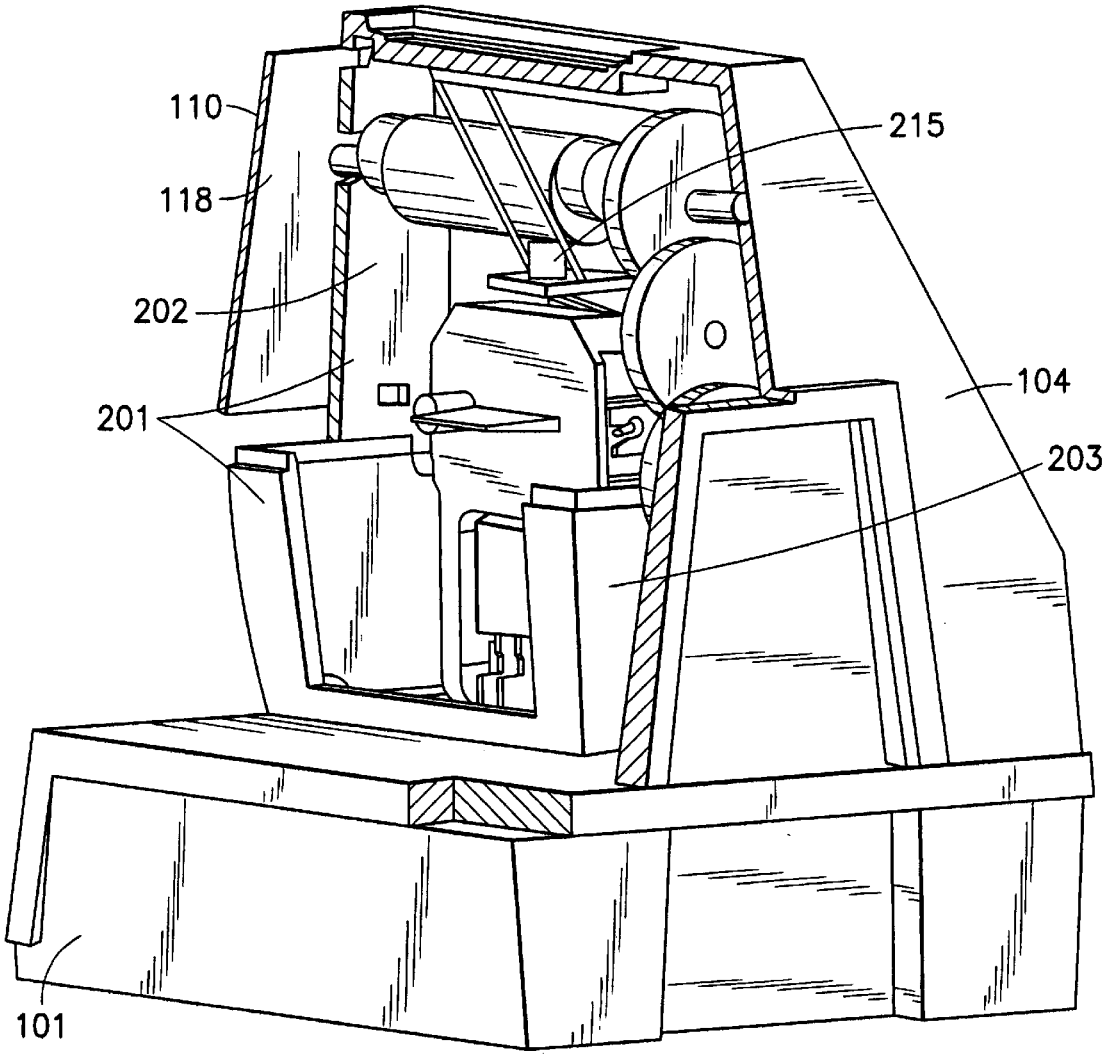

Referring now to FIGS. 5A and 5B, a cam shaft 209 is rotatably mounted on the printer rack 100. Preferably, the one end of the cam shaft 209 is mounted on the vertical support member 104 and the other end is mounted on the front support member 110.

The cam shaft 209 is provided thereon with a cylindrical cam (a helix) 212. The helix comprises two ridges 213 arranged in a helical format and a slot 214 between the ridges. The cylindrical cam 212 is in moving connection to the printer 205. Preferably the printer has a drive pin 215 which is fitted into the groove 214 of the moving cam as shown in FIG. 6B, and preferably the drive pin is a floating drive pin which fits into the helix groove at variable depths as the clamping piece moves up and down. The function of the helix is to move the printer in a generally horizontal front to back motion, i.e., towards and away from the vertical support member 104. Alternatively, the components of the invention can be rearranged such that the printer can move generally left to right in a motion parallel to the vertical support member.

The cam shaft 209 is further provided thereon with one or more means for raising and lowering the clamping piece so that the clamping piece clamps the article during printing. In a preferred embodiment, the movement of the clamping piece brings the printer in close proximity to the printable article.

In a preferred embodiment, the means for moving the clamping piece up and down includes one or more cam discs 216 attached to the cam shaft 209 as shown in FIG. 5A. For example, one cam disc 216 may be attached at either end of the cam shaft 209, or two cam discs 216 may be arranged such that one cam disc 216 is placed at each end of the cam shaft 209.

In an alternative embodiment, the means for moving the clamping piece 201 up and down includes one or more eccentrics disposed on the cam shaft 209. Each eccentric is attached to an end of the crank shaft which is coupled at its opposite end to the clamping piece 201 such that as the cam shaft 209 rotates and the crank shaft moves away from the base the clamping piece 201 is pulled away from the base 101. Conversely, as the crank shaft moves towards the base, clamping piece 201 is allowed to move towards the base 101 and to perform its clamping function.

Where the moving means comprise cam discs 216, the cam discs 216 must be positioned in a movable relationship with the clamping piece 201. In a preferred embodiment, the tops of the cam discs contact a horizontal surface of the clamping piece such that as the cam shaft 209 turns, the clamping piece moves up and down, i.e., towards and away from the base 101. In a preferred mode, the clamping piece is forced up by the cam discs 216 and forced down by the springs 107.

In an alternative embodiment, the cam discs 216 are located at each end of the cam shaft 209 and are disposed within openings (not shown) in the clamping piece. For example, the openings can be round openings. As the cam 212 rotates, the cam disc 218 pushes against the upper edge of the opening in the clamping piece 201, forcing the clamping piece 201 away from the base 101. As the cam disc 216 rotates further, the clamping piece 201 moves toward the base 101 to perform its clamping function.

A motor 221 mounted on the printer rack 201 for turning the cam shaft 209. In a preferred mode the motor is located in the base 101 and is connected to the drive shaft by a drive train.

While it will be appreciated by one of ordinary skill in the art that the components of the printing device can be arranged in a variety of ways, a typical arrangement is as follows. The printer ordinarily remains in a resting position closest to the vertical support member 104, and at such resting position, the cam disc 216 presses against the clamping piece 201 such that the clamping piece 201 is up, leaving an opening 114 for inserting the printable article. After the user inserts the printable article, and presses an actuation switch 301, the motor rotates the cam shaft 209, simultaneously clamping the printable article and moving the printer across the printable article as the printer prints. As the motor 221 continues to turn, the cam disc moves the clamping piece 201 back to the up position and the printer is moved back across the printable article in the up position so that the pressure applied by the clamping piece is relieved and the user can remove the printable article. It preferably takes one complete rotation of the cam shaft 209 to move the printer from its resting position, across the printable article, and back to its resting position.

The printing device of the present invention may be employed to print any suitably sized printable article. The thickness of a printable article is limited by the distance from the bottom 222 of the clamping piece 201 to the top 115 of the base 101 when the clamping piece 201 is in the up position. Such printable articles may, for example, comprise sheet or web articles, cards, envelopes, boxes, etc. In a preferred aspect of the present invention, the printable article is a time card.

In an alternative embodiment, the base 101 contains a movable portion with an arm extending generally vertically upwardly along the vertical support member 104. The movable portion and the arm are in a moving relationship with the printer rack. Such moving relationship may, for example, be based on the relationship between the external geometry of the movable portion and the internal geometry of the printer rack, as described for the clamping piece hereinabove. In this alternative, the clamping piece 201 is not moveable and may be immovably attached to the printer rack. Instead, the arm of the moveable portion of the base is moved up and down by the cam disc or other moving means as described hereinabove, thus moving the base up and down. The printable material is clamped by the pressure of the movable portion of the base against the bottom portion of the clamping piece.

In a further alternative embodiment, the arrangement is as described in the immediately preceding paragraph but with both the base and the clamping piece being moveable. In this embodiment, separate moving means as described hereinabove are employed on the cam shaft which independently move the moveable portion of the base and the clamping piece together to clamp the printable article. Alternatively, multiple cam shafts containing moving means as described above are employed to move the moveable portion of the base and the clamping piece together.

It will be appreciated that while the specification illustratively describes the invention in terms of vertical and horizontal members, up and down movements, etc., these terms are not intended to limit the present invention to one position only. The invention may, for example, be mounted on a wall so that the printable object may then be inserted either from the top or from the bottom. In such position, mounted on a wall, the normally vertical members are positioned horizontally and the normally horizontal members are positioned vertically.

What is claimed is:

1. A printing device, comprising:

(1) a printer rack including:

(a) a base having a front portion and a rear portion;

(b) a vertical support member having a top portion and a bottom portion, with the bottom portion of the vertical support member being secured to the rear portion of the base, with the vertical support member extending upwardly from the base in a generally vertical direction;

(c) a horizontal support member having a front portion and a rear portion, with the rear portion being attached to the top portion of the vertical support member and extending outwardly from the vertical support member in a generally horizontal direction;

(d) a front support member having an upper portion and a lower portion, with the upper portion being attached to the front portion of the horizontal support member and extending generally vertically downwardly toward the base but terminating prior thereto, so as to define a space between the lower portion of the front support member and the base, wherein the space is of a size accommodating insertion therein of an article for printing;

(2) a clamping member having a front edge and a rear edge, and being movably mounted between the front support member of the printer rack and the vertical support member of the printer rack such that the clamping member can move toward and away from the base;

(3) a printer movably mounted on the clamping member;

(4) a cam shaft rotatably mounted on the printer rack and provided thereon with:

(a) a cylindrical cam coupled in motive drive relationship with the printer for moving the printer toward and away from the vertical support member; and (b) means for raising and lowering the clamping piece so that the clamping piece clamps the article during printing to effect rotation of the cam shaft;

(5) a motor mounted on the printer rack and coupled with the cam shaft.

2. The printing device of claim 1 wherein the clamping piece is moveably constrained between the vertical support member and the front support member by external geometry of the clamping piece in relation to internal geometry of the vertical and front support members.

3. The printing device of claim 1 wherein the clamping piece further comprises ridge elements on the front and rear portions thereof and the vertical support member and the front support member further comprise groove elements on interior portions thereof and the ridge elements fit within the groove elements such that the clamping piece can move toward and away from the base.

4. The printing device of claim 1 wherein the means for raising and lowering the clamping member comprises at least one cam disc.

5. The printing device of claim 1 wherein the means for raising and lowering the clamping member is one or more crank shafts disposed on the cam shaft, and wherein each such crank shaft is connected at one end to an eccentric and at an opposite end to the clamping piece.

6. The printing device of claim 1 further comprising one or more springs attached at one end to the printer rack and at the other end to the clamping piece so as to normally force the clamping piece towards the base.

7. The printing device of claim 6 wherein the spring is disposed in a pushing relationship between the horizontal support member and the clamping piece.

8. The printing device of claim 1 further comprising one or more friction-enhancing elements located on one or more elements from the group comprising: a top portion of the base and the a bottom portion of the clamping piece.

9. The printing device of claim 1 wherein the friction-enhancing element is composed of a material selected from the group consisting of plastic, rubber, wood, and metal, and composites of two or more thereof.

10. The printing device of claim 1 wherein the article for printing is a time card.

11. The printing device of claim 1 wherein the printer rack comprises a unitary molded article.

12. The printing device of claim 1 wherein the printer rack article is formed of a material selected from the group consisting of: polystyrene, polyurethane, polyvinylchloride (PVC), polycarbonate (PC), polysulfone, polyethylene, acrylonitrile butadiene styrene (ABS), ABS/PVC blend, and ABS/PC blend.

13. The printing device of claim 1 further comprising a drive train mounted on the printer rack operationally connecting the motor to the cam shaft.

14. The printing device of claim 1 wherein the clamping piece is comprised of a front support member, a rear support member and a bottom.

15. The printing device of claim 16 wherein at least the front and bottom support members are formed of a transparent material.

16. A printing device comprising:

(1) a printer rack comprising a base, a vertical support member, a horizontal support member and a front support member all molded as a single-piece structure from a moldable material:

(a) the base having a front portion and a rear portion;

(b) the vertical support member having a top portion and a bottom portion, the bottom portion of the vertical support member being attached to the rear portion of the base, and the vertical support member being erected from the base in a generally vertical direction;

(c) the horizontal support member having a front portion and a rear portion, the rear portion being attached to the top portion of the vertical support member and extending from the vertical support member in a generally horizontal direction;

(d) the front support member having an upper portion and a lower portion, the upper portion being attached to the front portion of the horizontal support member and extending generally vertically downward towards the base but without contacting the base so as to leave a space between the lower portion of the front support member and the base for the insertion of an article for printing;

(2) a clamping piece having a front edge and a rear edge, said clamping piece being movably mounted between the front support member of the printer rack and the vertical support member of the printer rack such that the clamping piece can move towards and away from the base;

(3) a dot matrix printer movably mounted on the clamping piece;

(4) a cam shaft rotatably mounted on the printer rack and provided thereon with:

(a) a cylindrical cam in moving connection to the printer for moving the printer towards and away from the vertical support member; and (b) one or more cam discs for raising and lowering the clamping piece so that the clamping piece clamps the article during printing;

(5) a motor mounted on the printer rack for turning the cam shaft.

17. A method of printing information on a printable article, comprising:

(A) providing a printing device comprising:

(1) a printer rack including:

(a) a base having a front portion and a rear portion;

(b) a vertical support member having a top portion and a bottom portion, the bottom portion of the vertical support member is attached to the rear portion of the base, and the vertical support member is erected from the base in a generally vertical direction;

(c) a horizontal support member having a front portion and a rear portion, the rear portion is attached to the top portion of the vertical support member and extends from the vertical support member in a generally horizontal direction;

(d) a front support member having an upper portion and a lower portion, the upper portion is attached to the front portion of the horizontal support member and extends generally vertically downward towards the base but without contacting the base so as to leave a space between the lower portion of the front support member and the base for the insertion of an article for printing;

(2) a clamping piece having a front edge and a rear edge, said clamping piece is movably mounted between the front support member of the printer rack and the vertical support member of the printer rack such that the clamping piece can move towards and away from the base;

(3) a printer movably mounted on the clamping piece;

(4) a cam shaft rotatably mounted on the printer rack and provided thereon with:

(a) a cylindrical cam in moving connection to the printer for moving the printer towards and away from the vertical support member; and (b) one or more means for raising and lowering the clamping piece so that the clamping piece clamps the article during printing;

(5) a motor mounted on the printer rack for turning the cam shaft;

(B) inserting the printable article into the printing device; and (C) actuating the printer motor to rotate the cam thereby simultaneously lowering the clamping piece to secure the printable article and moving the printer across the printable article while the printer prints the information on the printable article.

18. A method according to claim 16 wherein the printable article comprises a time card.

19. A method according to claim 16 wherein the information comprises time and date information.

* * * * *